United States Patent [19]

Prudhon et al.

[11] 4,263,234

[45] Apr. 21, 1981

[54] METHOD OF INTIMATE CONTACTING/SEPARATING OF PLURAL PHASES AND PHASE CONTACTOR/SEPARATOR APPARATUS THEREFOR

[75] Inventors: Francois Prudhon, Versailles; Augustin Scicluna, Aubervilliers; Jean-Michel Verdier, Paris, all of France

[73] Assignee: Rhone-Poulenc Industries, Paris, France

[21] Appl. No.: 28,894

[22] Filed: Apr. 10, 1979

[30] Foreign Application Priority Data

Apr. 10, 1978 [FR] France ..... 78 10500

[51] Int. Cl.[3] ..... B01F 3/04

[52] U.S. Cl. ..... 261/153; 159/4 B; 159/48 R; 239/406; 261/78 A; 261/79 A; 261/115; 261/116; 423/304; 423/522; 426/471; 426/474

[58] Field of Search ..... 261/76, 79 A, 77, 153, 261/115-118, DIG. 54, DIG. 75, 152, 78 A; 423/DIG. 2, 304, 522; 239/403, 405, 406; 159/4 B, 4 E, 48 R; 106/109; 431/173; 55/235-238, 257 R

[56] References Cited

U.S. PATENT DOCUMENTS

| | | | |
|---|---|---|---|
| 1,183,098 | 5/1916 | Merrell et al. | 261/79 A X |
| 2,887,390 | 5/1959 | Coulter et al. | 159/4 B X |
| 2,893,871 | 7/1959 | Griffin | 159/4 B |
| 3,039,107 | 6/1962 | Bradford | 159/4 B |
| 3,131,237 | 4/1964 | Collins, Jr. | 261/153 |
| 3,177,634 | 4/1965 | Latham, Jr. et al. | 261/79 A X |
| 3,211,538 | 10/1965 | Gross et al. | 423/DIG. 2 |
| 3,231,413 | 1/1966 | Berquin | 159/48 R X |
| 3,274,752 | 9/1966 | Huyghe et al. | 261/153 X |
| 3,275,063 | 9/1966 | Tailor | 261/118 X |
| 3,412,529 | 11/1968 | Tailor | 261/7 A X |
| 3,758,081 | 9/1973 | Prudhon | 261/DIG. 54 |

FOREIGN PATENT DOCUMENTS

| | | | |
|---|---|---|---|
| 1438057 | 6/1976 | United Kingdom | 261/79 A |

*Primary Examiner*—Richard L. Chiesa
*Attorney, Agent, or Firm*—Burns, Doane, Swecker & Mathis

[57] ABSTRACT

Intimate contacting of plural, physically disparate phases is achieved by establishing a current of axially extending, axially symmetrical helical flow of a first phase; separately establishing a current of coaxially extending, rectilinear flow of a physically disparate second phase, the currents of said first and said second phases being maintained physically separated from each other; circulating and directing said currents which comprise the plural phases to a zone of restricted flow passage with respect to said helical flow, whereby said plural currents converge and are intimately, homogeneously admixed and whereat such zone of convergence the momentum of the first phase helical flow is at least 100 times greater than the momentum of the second phase, coaxial rectilinear flow such as to effect atomization via transfer of momentum, and ultimately effecting phase separation of the product of admixture. Cooling means provided at or contiguous the zone of convergence ensure that atomized particles impinging on the wall members comprising said cooling means are liquefied to form a continuous liquid film thereon, thus effecting the continuous wetting and washing of said wall members and preventing deposition thereon of any encrusting solids.

13 Claims, 4 Drawing Figures

METHOD OF INTIMATE CONTACTING/SEPARATING OF PLURAL PHASES AND PHASE CONTACTOR/SEPARATOR APPARATUS THEREFOR

CROSS-REFERENCE TO RELATED APPLICATIONS

[1] Prudhon and Scicluna copending application, Ser. No. 013,295, filed Feb. 21, 1979, a continuation of [2] abandoned application, Ser. No. 872,151, filed Jan. 25, 1978, itself a continuation-in-part of [3] abandoned application, Ser. No. 770,802, filed Feb. 22, 1977. The Ser. No. 770,802 application [3] is itself a continuation of [4] abandoned application, Ser. No. 479,774, filed June 17, 1974; and [5] copending application, Ser. No. 916,477, filed June 19, 1978, is a continuation of said abandoned application Ser. No. 770,802 [3]. Cf. [6] Prudhon and Scicluna copending application, Ser. No. 019,584, filed Mar. 12, 1979, itself a continuation of [7] abandoned application, Ser. No. 921,073, filed June 30, 1978, which in turn is a continuation-in-part of said abandoned application Ser. No. 872,151 [8] abandoned application, Ser. No. 770,053, filed Feb. 18, 1977, itself a continuation of [9] abandoned application, Ser. No. 590,812, filed June 27, 1975; and [10] Prudhon, Fantino and Mounier application, Ser. No. 591,333, filed June 30, 1975, now U.S. Pat. No. 4,086,099.

All of the foregoing applications are commonly assigned to the assignee hereof, and each is hereby expressly incorporated by reference in its entirety and relied upon.

BACKGROUND OF THE INVENTION

1. Field of the Invention

The present invention relates to the intimate contacting or admixture of a plurality of distinct physical phases, and plural phase contactor therefor; more especially, the invention relates to the intimate contacting of plural, distinct physical phases and ultimate separation of the various products resulting from such admixture.

2. Description of the Prior Art

A great variety of gas/liquid, and other phase contactors, mixers or separators, whether of pneumatic, mechanical, or other type, are of course well known to the state of this art. Equally well known, on the other hand, is the art appreciation of the various difficulties that are encountered in attempting to disperse, disintegrate, concentrate, comminute or pulverize, e.g., a liquid in a gaseous environment or treatment phase, such as, for example, effecting the drying of certain liquid materials through a spray drying technique. An ideal dryer of this type would comprise a vertical, cylindrical contact zone in which the gas and the dispersed liquid droplets are uniformly, regularly distributed, with the liquid being dispersed or entrained therein in the form of substantially equally sized droplets. Ideally, all of the droplets would follow the same flow path through the apparatus as to be subjected to the same treatment and, accordingly, to continuously give rise to the formation of identical product. Stated differently, the entire volume of the physical phase to be treated, in this spray drying example the same being a dispersed liquid droplet phase, should be subjected to the same historical profile operationally in order to receive an essentially identical amount and duration of treatment by the treatment medium or phase, under the same conditions [especially those of temperature and concentration]. And the immediately aforesaid of course presupposes or implies the realization or attainment of a precisely, indeed near perfectly controlled rate of flow.

In the aforenoted, commonly assigned copending application, Ser. No. 916,477, filed June 19, 1978, it has been shown that certain conditions very close to the ideal can be attained by insuring flow or distribution of vortex type, by operating within certain well defined parameters of both geometry and kinetics. As disclosed in said application Ser. No. 916,477, in an initial stage in the process the plural phases are manipulated upstream of their convergence by supplying same to a cylindrical distribution zone, at least one of the phases being introduced via a helical trajectory inducing inlet and being axially extended, while maintained in an axially symmetrical, helical flow path, through said distribution zone. By "axially symmetrical, helical flow path", through said distribution zone. By "axially symmetrical, helical flow path", there is denoted a regularly repeating, helical path of axially extending downward flow which is essentially symmetrical with respect to at least one plane including the axis of such helical flow. At least one other phase is also introduced to the distribution zone, via suitable inlet and it too is axially extended therethrough, but in this instance the path of downward flow is essentially rectilinear and proceeds at a speed of from 0.03 to 3 m/sec. The longitudinal axis of the path of rectilinear flow is, moreover, coaxial with the longitudinal axis of the path of helical flow. The current of circulating helical flow next progresses to a confining zone of restricted flow passage so constructed that the minimum momentum of the helical flow is at least 100 times greater than the momentum of the coaxial rectilinear flow, and such that the plural flow paths or separately supplied phases converge and are combined, blended and admixed in yet a third distinct zone, the contact zone. Thus, the trajectory imparted by the helical flow, at its point of exit from the zone of restricted flow passage, forms one of the classes of generatrices of a hyperboloid to a thin surface, or, more correctly, a layered stack of a plurality of hyperboloids. Said generatrices are conveyed through a series of circles to form a ring of narrow width which is situated downstream of the restricted passage for the helical flow, but upstream of its divergence. This ring surrounds or circumscribes a zone of depression, the effects of which are manifested both upstream, on the phase constituting rectilinear flow, as well as downstream, on the phase constituting circulating helical flow, by effecting the recycling of a portion of such fluids. In this fashion, in the zone downstream from the area of combining or convergence of the separately supplied fluids or plural flow paths, and in the same plane which is perpendicular to their coaxis, all vectors of velocity of the individual elements constituting total volume are equal in absolute value, are divergent and are mutually subtracted upon rotation about the coaxis; hence, at two successive intervals, two distinct units of volume in the same trajectory evidence the same historical processing profile, thus assuring maintenance of contact between the two phases. Accordingly, if the rectilinear flow, for example, be constituted of a liquid phase and the helical flow of a gaseous phase, the liquid phase will be disintegrated, fractionated or atomized into a multitude of droplets, with each droplet being dispersed in a given volume of the gas and subjected to a certain movement or velocity thereby, by being physically swept along with said gas, thus creating the effect of centrifugation; this phenomenon enhances contact with the vector gas and, in those cases where combustion results, insures ignition and flame stability. Such a process, therefore, is a notably marked advance in the art of rapid intimate contact between, and ultimate separation of, two disparate phases. Indeed, such process is eminently well suited for the treatment of highly thermally sensitive materials with very hot gases. For example, milk [which should not be heated to a temperature in excess of about 80° C.] can conveniently be dried with gases as hot as 500° C. without undergoing deterioration or degradation. And an added advantage of this process is that such operations as drying and evaporation can be carried out in high energy yield, in minimum space requirement installations. Nonetheless, a product separation problem arises, for example, the elimination of gases from any solid or liquid phase recovered. As another example, like phase separation difficulties were encountered in attempting to concentrate such acids as sulfuric and phosphoric. In the aforementioned application, Ser. No. 916,477, this function of separation was attempted to be assured by means of a cyclone. Unfortunately, though, such a device has considerable space requirements and if it be necessary that a predetermined efficiency be attained, utilization of such a device fosters a substantially cost increase, even without taking into account energy loss. Mofidication of the cyclone itself has also been proposed to alleviate such problems, for example, by placing helical guide vanes or the like inside the cyclone. But, as can be seen from, e.g., Perry and Chilton, *Chemical Engineers' Handbook,* 5th Edition, pp. 20–86, McGraw-Hill Book Co., such vanes or the like, when placed inside the cyclone, will have a detrimental effect on performance of the unit because of reduced pressure throughout and a correspondingly even greater reduction in collection, or product recovery, efficiency.

Thus, it was proposed, in copending application, Ser. No. 013,295, that if a cylindrical wall member be integrally secured to the trajectories or outlet of the contact zone of any device disclosed in the Ser. No. 916,477 application, and an abrupt change or variation in the velocity field of at least one of the plural phases be effected thereby, while at the same time maintaining the general direction of flow of said phases, excellent phase separation is obtained, even though a device of but small dimensions is used and without encountering those inconveniences or disadvantages which result from the modification of the known and classical cyclones by insertion of helical guide vanes or the like.

More particularly according to the invention disclosed and claimed in said application Ser. No. 013,295, there are characterized both apparatus and process for the formation of an intimate, homogeneous product mix comprising at least two disparate physical phases, and for the ultimate facile separation and recovery of the various products resulting from such mixing. Consistent with such invention, an intimate, homogeneous admixture of said phases is assured by mutually contacting the same by means of a flow of vortex type. This is accomplished by supplying at least one of the phases to a first cylindrical distribution zone via a helical trajectory inducing inlet, and whereby the same is axially extended through such zone while being maintained in an axially symmetrical, helical flow path. By "axially symmetrical, helical flow path", here too is intended a regularly repeating, helical path of axially extending downward flow which is essentially symmetrical with respect to at least one plane including the axis of the helical flow. At least one other phase is also introduced to this first distribution zone, via suitable inlet, and it too is axially extended therethrough, but in this instance the path of downward flow is essentially rectilinear. The longitudinal axis of the path of rectilinear flow is, moreover, coaxial with the longitudinal axis of the path of helical flow. The current of circulating helical flow next progresses to a confining zone of restricted flow passage so constructed that the minimum momentum of the helical flow is at least 100 times greater than the momentum of the coaxial rectilinear flow, and such that the plural flow paths or separately supplied phases converge and are combined, blended and admixed in yet a third distinct zone, the contact zone. In the contact zone, the trajectories common to the different phases are directed against a cylindrical surface, the intimate admixture remaining in contact with said surface as a result of the effects of that centrifugal force imparted to the system by means of the circulating, helical flow. Phase separation is next effected by an abrupt change in the field of velocities of at least one of the disparate phases, while at the same time maintaining the general direction of flow of the several phases. Ultimately, the products resulting from the intimate admixture or contacting of the various phases are recovered separately. The plural phases subjected to treatment according to the application Ser. No. 013,295 may be either gaseous, liquid or solid phases. For example, the concentration of a gas/liquid admixture is readily effected, as are (i) the drying of a gas/solid mixture, (ii) the decantation of two immiscible liquids, and (iii) the absorption washing of a gas with a liquid; the invention of the application Ser. No. 013,295 is particularly worthwhile for the single step concentration [vis-a-vis the two-stage concentrations characterizing the then state of the art] of dilute solutions of phosphoric acid.

Unfortunately, though, in certain instances, due to the presence of a variety of impurities, processes carried out in consonance with the teachings of the application Ser. No. 013,295 proceed only difficultly. For example, in attempting to concentrate residual acidity deriving from the manufacture of titanium pigments, the presence of iron, typically manifested by the formation of iron salts, markedly detracts from process efficacy.

SUMMARY OF THE INVENTION

Accordingly, it has now surprisingly been found, and which is a major object of the present invention, that those difficulties and drawbacks characterizing the process/apparatus described in the application Ser. No. 013,295 are obviated simply by modifying the process/apparatus disclosed in application, Ser. No. 916,477, which process/apparatus features atomization by transfer of momentum in a distinct contact zone, such modification being the provision of an independent cooling zone at or contiguous the point of contact of the plural flow paths or separately supplied phases in said contact zone.

DETAILED DESCRIPTION OF THE INVENTION

Figure 1:
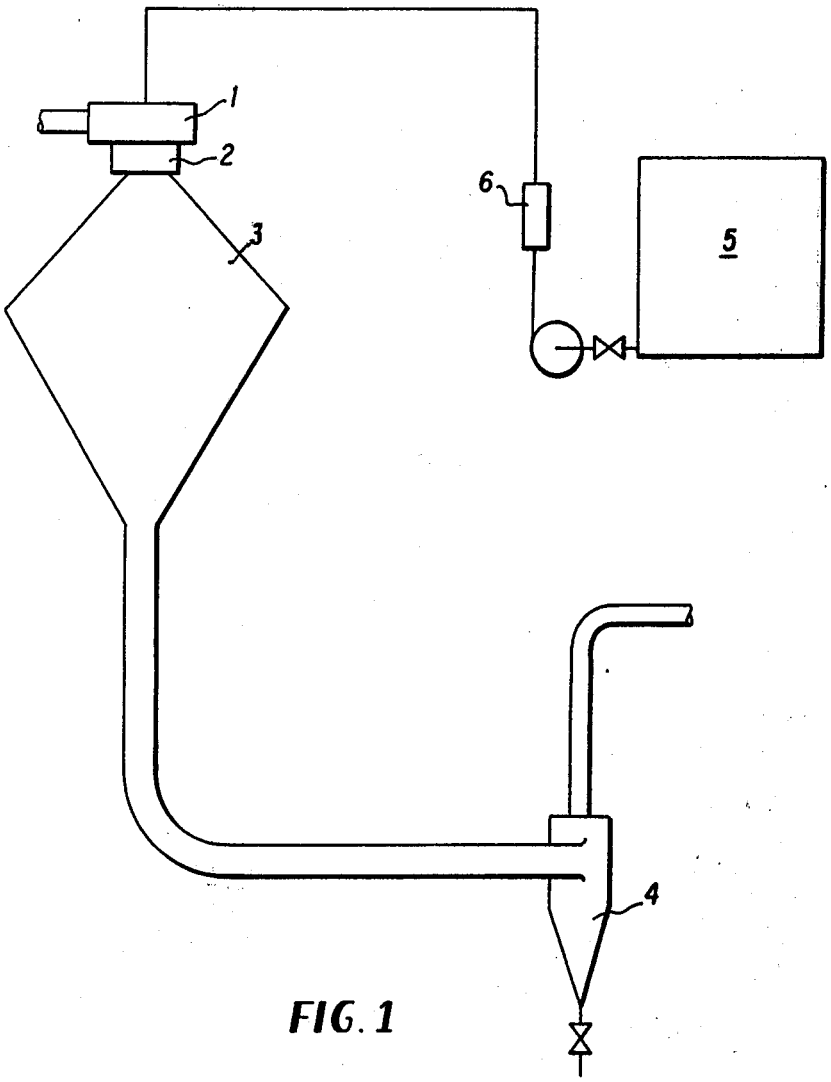
FIG. 1 is a schematic/diagrammatic representation of one embodiment of a phase contactor/separator according to the invention.

More particularly according to the present invention, there are provided both apparatus and process for the formation of an intimate, homogeneous product mix comprising at least two disparate physical phases, and for the ultimate facile separation and recovery of the various products resulting from such mixing. According to the invention an intimate, homogeneous admixture of said phases is assured by mutually contacting the same by means of a flow of vortex type as described in application, Ser. No. 916,477. This is accomplished by supplying at least one of the phases to a first cylindrical distribution zone via a helical trajectory inducing inlet, and whereby the same is axially extended through such zone while being maintained in an axially symmetrical, helical flow path. By "axially symmetrical, helical flow path", here too is intended a regularly repeating, helical path of axially extending downward flow which is essentially symmetrical with respect to at least one plane including the axis of the helical flow. At least one other phase is also introduced to this first distribution zone, via suitable inlet, and it too is axially extended therethrough, but in this instance the path of downward flow is essentially rectilinear and proceeds at a speed of from 0.03 to 3 m/sec. The longitudinal axis of the path of rectilinear flow is, moreover, coaxial with the longitudinal axis of the path of helical flow. The current of circulating helical flow next progresses to a confining zone of restricted flow passage so constructed that the minimum momentum of the helical flow is at least 100 times greater than the momentum of the coaxial rectilinear flow, and such that the plural flow paths or separately supplied phases converge and are combined, blended and admixed in yet a third distinct zone, the contact zone. In the contact zone, the trajectories common to the different phases are directed against a cylindrical surface, the intimate admixture remaining in contact with said surface as a result of the effects of that centrifugal force imparted to the system by means of the circulating, helical flow.

Also in or contiguous the very hot contact zone, or zone of atomization via transfer of momentum, cooling means are provided such that impinging atomized particles are immediately cooled and liquefied, giving rise to the formation of a continuous liquid phase, said liquid phase effecting the continuous wetting and washing of the wall surface members defining the cooling zone, thus preventing deposition thereon of any dry solids or residue originating from the atomized rectilinear flow. The temperature of such wall surface members defining the cooling zone must of course be no greater than the temperature of condensation of the atomized phase.

Phase separation is next effected by any of the means disclosed, e.g., in the application Ser. No. 916,477. Ultimately, the products resulting from the intimate admixture or contacting of the various phases are recovered separately.

According to the invention, the cooling means may be provided either within; or downstream from, the contact zone, e.g., same may be situate either at the head of any separator, not atypically a cyclone, or at the rectilinear flow outlet, or interposed at any point therebetween. Said cooling means, moreover, can be a simple sleeve, e.g., a graphite sleeve, provided internally with any circuit for the circulation of cooling fluid, for example, cold water and the like. It will be appreciated that any means whatsoever of effecting the cooling function are within the ambit of the invention.

It too will be appreciated that the invention is not limited to the treatment or concentration of any given solution, namely, the invention not only envisages concentration of sulfuric and phosphoric acid solutions, but also those of chromic acid, sheet metal pickling solutions, and any others.

An especially attractive application of the process according to this invention is the concentration of sulfuric acid solutions containing iron impurities; the iron is unexpectedly readily eliminated in the form of ferrous sulfate monohydrate. Desirably, such sulfuric acid solutions contain between 200 and 300 g/l of $H_2SO_4$ and from 30 to 60 g/l iron and the treatment consistent herewith includes establishing an axially symmetrical, helical flow path of air heated to an inlet temperature of between 750° and 1050° C., with the cooling means being maintained at a temperature of between 50° and 95° C. The outlet temperature of the hot air is between 150° and 200° C.

The process/apparatus of the invention is also admirably well suited for the single step concentration of phosphoric acid, affording single step concentrations in excess of 65% $P_2O_5$ from 25% solutions.

Advantageously, the inlet temperatures of the gases comprising the helical flow are between 750° and 1050° C., their outlet temperatures are between 150° and 300° C., and the temperature of the circulating fluid comprising the cooling means is between 50° and 95° C.

Figure 2:
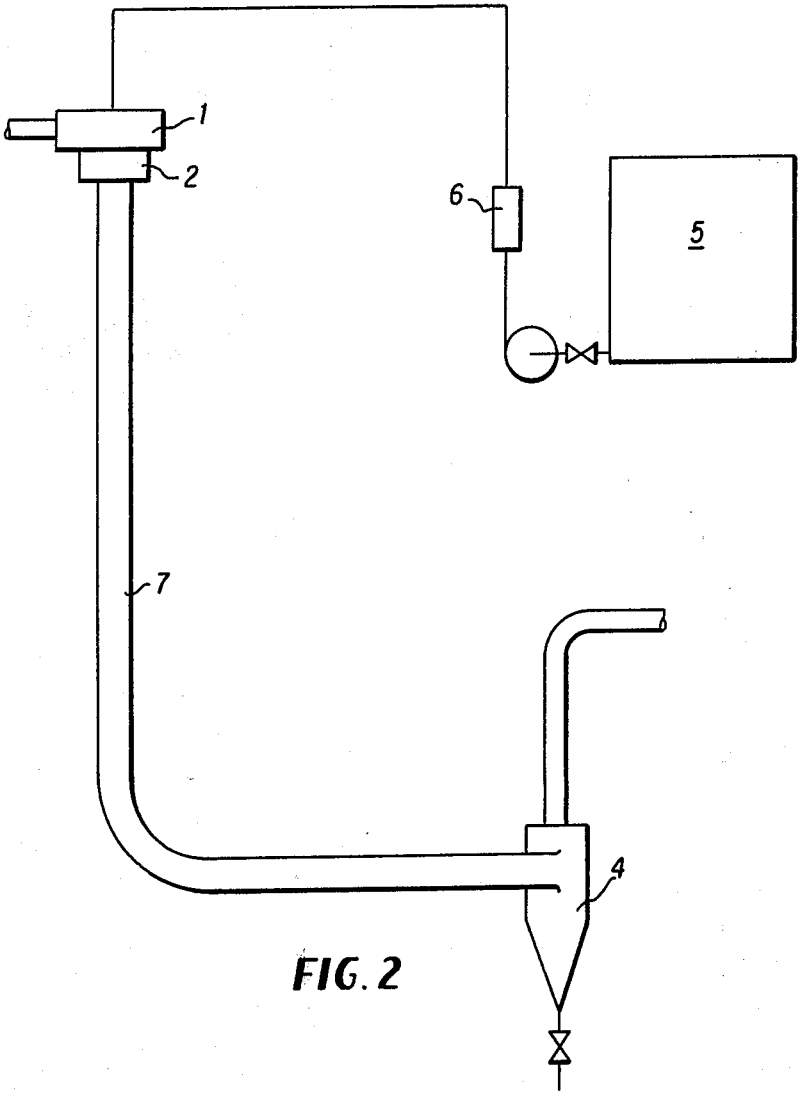
FIG. 2 is a schematic/diagrammatic represenation of another phase contactor/separator according to the invention.

Referring specifically to the Figures of Drawing, in FIGS. 1 and 2 are illustrated, schematically and diagrammatically, two different embodiments of a phase contactor/separator according to the invention. The FIG. 1 depicts a contactor/separator according to the invention consisting essentially of the "head" 1, cooling means 2, a treatment vessel 3 shown as being constructed from 2 truncated cones joined at a common base, a cyclone separator 4, a vat 5 containing any solution to be concentrated, and a filter element 6. The FIG. 2 depicts a contactor/separator tantamount to that of FIG. 1, save that the "cone" treatment vessel has been replaced by a cylindrical treatment vessel 7.

Figure 3:
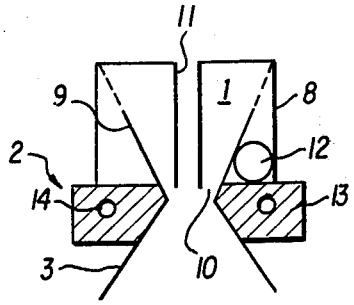
FIG. 3 is an axial, diagrammatical cross-sectional view of the head of the phase contactor/separator according to the invention.

In FIG. 3 there is depicted, in axial cross-section, the "head" 1 of FIGS. 1 and 2, and as further described in the application, Ser. No. 916,477. The head 1 includes an inverted, truncated and upwardly perforated cone 9 downwardly depending from a cylindrical casing 8. Coaxial therewith is the internal tubular conduit or pipe 11, the same coaxially extending through the upside end of the casing 8 and deep within the truncated cone 9, said truncated cone 9 terminating in an outlet 10 or confining zone of restricted flow passage. The perforations enable the establishment of a regularly repeating, helical path of axially extending downward flow which is essentially symmetrical with respect to at least one plane passing through the axis of the helical flow, such flow being established by means of the helical trajectory inducing tangential inlet 12 for the gaseous phase. The wall member comprising the treatment vessel 3 is integral with the outlet 10.

Figure 4:
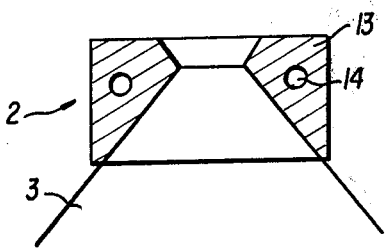
FIG. 4 is an axial, diagrammatical cross-sectional view of the cooling zone or means comprising the head as shown in FIG. 3.

The cooling element is shown in the FIGS. 3 and 4, the same comprising a graphite body member 13 provided with an internal circuit 14 for the circulation of the cooling liquid.

The contactor/separator according to the invention is otherwise tantamount to that described in the application Ser. No. 916,447; likewise as regards the operating conditions therefor.

In order to further illustrate the present invention and the advantages thereof, the following specific examples are given, it being understood that same are intended only as illustrative and in nowise limitative. In each of the following examples, the apparatus utilized comprised a "head" 1 having an overall outside diameter of 270 mm, a height of 120 mm, the diameter of the outlet 10 was 45 mm and the diameter of the largest cross-sectional area of the truncated, perforated inverted cone 9 was 166 mm. The cooling element 2 had an overall outside dimension of 130 mm in length and was 66 mm in height. The outlet diameter of the internal tubular conduit 11 was 24 mm and the apex angle of the inverted, truncated cone 9 was 90°; the cooling liquid utilized was ambient temperature water, thus maintaining a temperature on the order of 70° C. in the graphite block 13.

EXAMPLE 1

In this example, a pure sulfuric acid solution was concentrated by means of hot air in apparatus as shown in FIG. 1, but lacking the cooling element. The operating conditions were:

| | |
|---|---|
| Air | Inlet temperature 800° C. |
| Air | Outlet temperature 165° C. |
| Air flow | 80 $m^3/h$ under 3500 mm water pressure |
| Liquid flow | 46.5 kg/h |

From a sulfuric acid solution having a titer of 23%, a 69% sulfuric acid concentrate was directly obtained.

EXAMPLE 2

Utilizing apparatus as shown in FIG. 2 but without the cooling element, a pure phosphoric acid solution with a 25% content of $P_2O_5$ was treated under the same conditions as in Example 1 of inlet temperature (800° C.) and air flow (80 $m^3/h$) under 3500 mm pressure, with an outlet temperature of 185° and like liquid flow. A 65% acid, expressed in $P_2O_5$, was obtained.

The acid, as could be predicted consistent with the theory of reorganization of pure acids, was entirely in the ortho form.

EXAMPLE 3

In this example, a residual solution from the manufacture of $TiO_2$ pigments comprising 250 g/l $H_2SO_4$ and 50 g/l iron was treated in apparatus as shown in FIG. 1. Rapid encrusting of the apparatus was observed.

A cooling element was then inserted according to the invention, being maintained at a temperature of 70° C.

Other operating conditions were as follows:

| | |
|---|---|
| Air | Inlet temperature 850° C. |
| Air | Outlet temperature 160° C. |
| Air flow | 80 $m^3/h$ under 3500 mm water pressure |
| Liquid flow | 40 kg/h |

A solution was obtained containing 1030 g free $H_2SO_4$ and 4 g iron per liter (yielding a solution of $H_2SO_4$ having a titer of 64% free acid). In this operation, the iron was easily separated by means of simple decantation, in the form of ferrous sulfate monohydrate, which precipitated when the concentration was increased.

EXAMPLE 4

Utilizing the same apparatus as in Example 3, conforming to FIG. 1, and maintaining the cooling element at 70° C., a 25% pure phosphoric acid solution was treated under the following conditions:

| | |
|---|---|
| Air | Inlet temperature 800° C. |
| Air | Outlet temperature 200° C. |
| Air flow | 80 $m^3/h$ |
| Liquid flow | 40 kg/h |

A phosphoric acid comprising 70% $P_2O_5$, 97% being in ortho form, was obtained.

EXAMPLE 5

This example was identical to Example 4, except that the outlet temperature of the gas was 250° C. An acid comprising 78% $P_2O_5$, 28% being in ortho form, was obtained.

The foregoing examples clearly demonstrate the advantages of the present invention. Not only can solutions containing impurities be concentrated pursuant thereto, heretofore not possible, but also same enables the use of high temperature gases, e.g., having a temperature on the order of 800° C., while maintaining equally high outlet temperatures, without risking damage to linings which are inherently fragile at such temperature, but which must be used because of their resistance to the chemical action of the reactants. It will also be seen that the invention enables realization of highly concentrated phosphoric acids, having a content of greater than 65% $P_2O_5$.

While the invention has been described in terms of various preferred embodiments, the skilled artisan will appreciate that various modifications, substitutions, omissions, and changes may be made without departing from the spirit thereof. Accordingly, it it intended that the scope of the present invention be limited solely by the scope of the foregoing claims.

What is claimed is:

1. A process for the intimate contacting of plural, physically disparate phases, comprising (i) establishing a vertically descending current of axially extending, axially symmetrical helical flow of a first gaseous phase, (ii) separately establishing a current of coaxially downwardly vertically extending, rectilinear continuous jet stream of a physically disparate second liquid phase, (III) maintaining said currents of said first and second phases physically separate from each other, (iv) circulating and directing said currents which comprise the plural phases to a zone of restricted flow passage with respect to said helical flow, (v) at said zone of restricted flow passage, converging and intimately, homogeneously admixing said plural currents, and atomizing into a multitude of droplets, and entraining said rectilinear jet stream current within said helical current of gaseous flow, and maintaining at such zone of convergence a momentum of the first phase helical flow of at least 100 times greater than the momentum of the second phase, coaxial rectilinear flow, (vi) concurrently establishing a flow defining a layered horizontal stack of a plurality of hyperboloids by means of the trajectory of said helical current of gaseous flow, which, at a point downstream from said zone of restricted flow passage coestablishes a zone of narrower width than said zone of restricted flow passage, and (vii) also establishing a zone of cooling at or contiguous the said zone of convergence, said zone of cooling being at a temperature such that atomized particles impinging on wall surface members defining same are liquefied and form a continuous liquid film thereon.

2. The process as defined by claim 1, further comprising (viii) diverging and abruptly changing the velocity of at least one of said plural phases, while at the same time maintaining the general direction of flow of said admixed plural phases, and whereby phase separation of the product of admixture results.

3. A process for the intimate contacting of plural, physically disparate phases, consisting essentially of (i) establishing a vertically descending current of axially extending, axially symmetrical helical flow of a first gaseous phase, (ii) separately establishing a current of coaxially downwardly vertically extending, rectilinear continuous jet steam of a physically disparate second liquid phase, (iii) maintaining said currents of said first and said second phase physically separate from each other, (iv) circulating and directing said currents which comprise the plural phases to a zone of restricted flow passage with respect to said helical flow, (v) at said zone of restricted flow passage, converging and intimately, homogeneously admixing said plural currents, and atomizing into a multitude of droplets, and entraining said rectilinear jet stream current within said helical current of gaseous flow, and maintaining at such zone of convergence a momentum of the first phase helical flow of at least 100 times greater than the momentum of the second phase, coaxial rectilinear flow, (vi) concurrently establishing a flow defining a layered horizontal stack of a plurality of hyperboloids by means of the trajectory of said helical current of gaseous flow, which, at a point downstream from said zone of restricted flow passage coestablishes a zone of narrower width than said zone of restricted flow passage, and (vii) also establishing a zone of cooling at or contiguous the said zone of convergence, said zone of cooling being at a temperature such that atomized particles impinging on wall surface members defining same are liquefied and form a continuous liquid film thereon.

4. The process as defined by claims 1 or 3, the temperature of the wall surface members defining the zone of cooling being no greater than the temperature of condensation of the atomized phase.

5. The process as defined by claim 4, wherein dilute phosphoric acid is concentrated with a hot gas.

6. The process as defined by claim 5, wherein a 25% $P_2O_5$ phosphoric acid solution is concentrated with air heated to a temperature of between 750° and 1050° C., and wherein the temperature of the wall surface members defining the zone of cooling is between 50° and 95° C.

7. The process as defined by claim 4, wherein dilute sulfuric acid is concentrated with a hot gas.

8. The process as defined by claim 7, wherein a sulfuric acid solution containing between 200 and 300 g/l sulfuric acid and 30 to 60 g/l iron is concentrated with air heated to a temperature of between 750° and 1050° C., and wherein the temperature of the wall surface members defining the zone of cooling is between 50° and 95° C.

9. A phase contactor for the intimate contacting of plural, physically disparate phases, which comprises (i) a distribution zone, said distribution zone being comprised of means for establishing a vertically descending current of axially extending, axially symmetrical helical flow of a first gaseous phase, means for separately establishing a current of coaxially vertically downwardly extending, rectilinear continuous jet stream of a physically disparate second liquid phase, and means for insuring physical separation from each other of said currents of said first and second phases, (ii) a contact zone, said contact zone being comprised of a zone of restricted flow passage with respect to the means of establishing the helical flow, means for the convergence and intimate homogeneous admixture of the separately supplied disparate phases, means for imparting a momentum to the gaseous first phase helical flow which is at least 100 times greater than the momentum of the second phase, coaxial rectilinear flow, means for atomizing into a multitude of droplets and entraining said rectilinear jet stream current within said helical current of gaseous flow, means for concurrently establishing a flow defining a layered horizontal stack of a plurality of hyperboloids via the trajectory of said helical current of gaseous flow, and means for establishing, at a point downstream from said zone of restricted flow passage, a flow zone of narrower width than said zone of restricted flow passage, and (iii) means for establishing a zone of cooling at or contiguous the said zone of convergence, and means for bringing said zone of cooling to a temperature such that atomized particles impinging on wall surface members defining same are liquefied and form a continuous liquid film thereon.

10. The phase contactor as defined by claim 9, said cooling means comprising a graphite sleeve provided with cooling liquid circulation conduit.

11. The phase contactor as defined by claim 9, further comprising (iv) a phase separation zone and means for effecting phase separation of the product of admixture of said plural phases.

12. The phase contactor as defined by claim 11, said phase separation zone being comprised of means for abruptly changing the velocity of at least one of said plural phases, means for maintaining the general direction of flow of said admixed plural phases, and means for effecting phase separation of the product of admixture of said plural phases.

13. A phase contactor for the intimate contacting of plural, physically disparate phases, consisting essentially of (i) a distribution zone, said distribution zone being comprised of means for establishing a vertically descending current of axially extending, axially symmetrical helical flow of a first gaseous phase, means for separately establishing a current of coaxially vertically downwardly extending, rectilinear continuous jet stream of a physically disparate second liquid phase, and means for insuring physical separation from each other of said currents of said first and second phases, (ii) a contact zone, said contact zone being comprised of a zone of restricted flow passage with respect to the means for establishing the helical flow, means for the convergence and intimate homogeneous admixture of the separately supplied disparate phases, means for imparting a momentum to the gaseous first phase helical flow which is at least 100 times greater than the momentum of the second phase, coaxial rectilinear flow, means for atomizing into a multitude of droplets and entraining said rectilinear jet stream current within said helical current of gaseous flow, means for concurrently establishing a flow defining a layered horizontal stack of plurality of hyperboloids via the trajectory of said helical current of gaseous flow, and means for establishing, at a point downstream from said zone of restricted flow passage, a flow zone of narrower width than said zone of restricted flow passage, and (iii) means for establishing a zone of cooling at or contiguous the said zone of convergence, and means for bringing said zone of cooling to a temperature such that atomized particles impinging on wall surface members defining same are liquefied and form a continuous liquid film thereon.

* * * * *